United States Patent [19]

Holm et al.

[11] 4,042,398

[45] Aug. 16, 1977

[54] POLYOLEFIN COATED PHOTOGRAPHIC BASE AND METHOD OF PRODUCING

[75] Inventors: Peter H. Holm, Osnabrueck, Germany; William L. Quartz, Pulaski, N.Y.

[73] Assignee: Schoeller Technical Papers, Inc., Pulaski, N.Y.

[21] Appl. No.: 623,679

[22] Filed: Oct. 20, 1975

[51] Int. Cl.[2] ..... G03C 1/86

[52] U.S. Cl. ..... 96/85; 96/67; 427/411; 427/419 D; 428/511; 428/512; 428/513

[58] Field of Search ..... 96/85, 67; 427/411, 427/419, 358, 372; 428/511, 512, 513

[56] References Cited

U.S. PATENT DOCUMENTS

| | | | |
|---|---|---|---|
| 3,411,908 | 11/1968 | Crawford et al. | 96/74 |
| 3,501,298 | 3/1970 | Crawford | 96/85 |
| 3,743,537 | 7/1973 | Honjo et al. | 96/85 |
| 3,769,020 | 10/1973 | Verburg | 96/85 |
| 3,783,003 | 1/1974 | Matsunisa et al. | 96/85 X |
| 3,787,214 | 1/1974 | Minagawa | 96/87 R |
| 3,864,132 | 2/1975 | Rasch et al. | 96/85 |
| 3,884,692 | 5/1975 | Minagawa et al. | 96/85 |
| 3,914,522 | 10/1975 | Sauerin et al. | 428/513 |

*Primary Examiner*—Edward C. Kimlin

*Attorney, Agent, or Firm*—Stephen H. Cagle; Wilson G. Palmer

[57] ABSTRACT

A process is provided to produce a novel photographic base by applying an aqueous coating composition containing aluminum oxide particles to at least one surface of a substrate, drying the coated substrate, applying a molten film of a polyolefin over at least one of the coated surfaces of the coated substrate, adhering the polyolefin to the coated surface, and cooling the polyolefin film to a temperature below the melt point of the polyolefin. The photographic base so produced may be further treated by applying a coating of a light sensitive silver halide emulsion to one side of the photographic base paper and drying the emulsion coated paper.

24 Claims, No Drawings

POLYOLEFIN COATED PHOTOGRAPHIC BASE AND METHOD OF PRODUCING

BACKGROUND OF THE INVENTION

This invention relates to the production of photographic base papers and photographic print papers produced therefrom having a polyolefin film on one or both sides of a substrate. In particular, it relates to a novel method of providing adhesion between the polyolefin film and the substrate.

Polyolefin coated papers and, in particular, polyethylene coated papers, have been introduced in recent years for use as photographic base papers to which may be applied photographic emulsions to produce light sensitive photographic elements. Such elements may be used to produce photographic prints. Prior to this, polyolefins, including polyethylene, were used to coat paper for many uses, principally for use as packaging and wrapping materials. Coating of such papers was conventionally by extrusion of a molten film onto paper and running the paper coated with the hot film through the nip of a pair of press rolls. Cooling of the film was accomplished by cooling the roll in contact with the hot film. Many of the uses required a bond between the paper and the polyolefin film greater than could be obtained by simply hot pressing the polyolefin film to the paper base. The use of adhesion promoters, such as treatment of the paper with a corona discharge or chemical primers, has been described in the prior art.

U.S. Pat. No. 3,371,002 describes the use of polyesters, urethanes, or preferably a mixture of these resins as chemical primers to promote the adhesion of polyolefins to paper in the production of packaging materials. U.S. Pat. Nos. 3,411,908 and 3,501,298 utilize a treatment of the paper by a corona discharge to bond polyolefins to paper to produce photographic papers which may be treated with photographic processing solutions. U.S. Pat. No. 3,411,908 also mentioned the use of organic titanates and polyethyleneimine to improve the adhesion of polyolefins to paper. Canadian Pat. No. 795,773 suggests the use of "adhesion primers" of undisclosed composition at a size press or priming station in line with the extrusion step to produce photographic papers. The use of colloidal silica to adhere certain synthetic films to paper is known from commercial literature.

Photographic base papers which are further coated with a light sensitive layer to form photographic print papers are normally sized papers made from pulps of high chemical purity. They have a moisture barrier film on both sides of the paper to prevent penetration of photographic development chemicals into the paper thereby discoloring the paper and spoiling the resultant photographic print. Polyethylene coatings are widely used as the moisture barrier films.

One difficulty usually encountered with the use of polyethylene coatings is the lack of adhesion of the polyethylene film to the comparatively smooth heavily sized paper surface. Another problem with such papers is "edge penetration". As used herein, this is defined as a measure of the penetration of development chemicals into the edges of a photographic print paper during development thereof.

Of the known processes of bonding polyethylene to paper, only the treatment of paper by a corona discharge has had commercial acceptance where the resultant paper was to be used in contact with photographic development chemicals. This method, though acceptable, has certain disadvantages as compared to the novel process of this invention. The corona discharge process requires additional equipment and the corona treatment must be done immediately prior to extruding the polyolefin film onto the paper surface. In contrast to this, the treatment with the novel primer of this invention can be done on the papermachine using equipment normally present, and the paper from the papermachine may be stored, if desired, and subsequently extrusion coated with a polyolefin with no reduction in the strength of the bond between the paper and the polyolefin.

STATEMENT OF THE INVENTION

In accordance with one aspect of this invention, a process is provided to produce a photographic base which comprises applying an aqueous coating composition to at least one surface of a substrate, said coating composition containing aluminum oxide particles, drying the coated substrate, applying a molten film of a polyolefin over at least one of said coated surfaces of said coated substrate, adhering said polyolefin to said coated surface, and cooling said polyolefin film to a temperature below the melt point of said polyolefin. The photographic base so produced may be further treated by applying a coating of a light sensitive silver halide emulsion to one side of the photographic base and drying the emulsion coating.

In accordance with another aspect of this invention, a photographic base paper is provided which comprises a substrate, a layer of aluminum oxide particles on at least one surface of the substrate and a polyolefin film on the layer of aluminum oxide particles, the layer of aluminum oxide particles providing a bond between the polyolefin film and the substrate. The photographic base paper may have a light sensitive silver halide emulsion adhered thereto.

DESCRIPTION OF THE INVENTION

Adhesion, as it is used herein, is a measure of the bond strength between the polyolefin film and the substrate and is determined as follows. Two half inch slits are made about an inch apart in one edge of a test piece of photographic base paper. The paper between the slits is peeled away from the test piece. The adhesion is satisfactory if the polyolefin film does not strip cleanly from the paper. This happens when the bond strength is greater than the internal strength of the substrate. Adhesion is not satisfactory if the polyolefin film strips cleanly from the paper. Such is the case if the paper has not been treated to promote adhesion of the polyolefin.

Edge penetration is determined by immersing a test piece of photographic paper approximately 1 inch below the surface of a developer solution containing commercially available GAF Color Print Paper Chemistry Type 7200 Color Developer at 21°-22° C. (pH 11.8) for a period of 15 minutes, followed by similarly immersing the test piece for 15 minutes in commercially available GAF Color Print Paper Chemistry Type 7200 Bleach Fix at 21°-22° C., followed by washing the test piece to remove the surface chemicals and air drying. After drying, the test piece is examined for discoloration (yellowing) of the edges. Discoloration from 0 to 0.3 millimeters from the edge of the test piece is satisfactory, from 0.4 to 1.0 millimeters is borderline and over 1.0 millimeters the edge penetration is commercially unacceptable.

Edge penetration is associated with adhesion to the extent that poorly adhered polyolefin films will allow the photographic chemicals to penetrate between the film and the substrate surface. Furthermore, any material added as an adhesion primer should not promote this penetration.

The substrate of this invention is normally paper which has been produced for photographic use. It is a heavily sized paper made from refined highly bleached pulps, such as alpha pulps, to reduce the impurities which might discolor or otherwise react with photographic chemicals. A preferred sizing material is an alkylketene dimer manufactured and sold as a 6% emulsion of the dimer under the tradename Aquapel 360X by the Hercules Powder Company. Size may be added to the pulp prior to forming the paper on a papermachine. The thickness of the paper substrate is normally from about 3 mils to about 10 mils.

Aluminum oxide particles having a particle size from about 1 millimicron to about 60 millimicrons perform satisfactorily as the adhesion primer in this invention. The preferred range is from about 5 millimicrons to about 40 millimicrons. A more preferred range is from about 5 millimicrons to about 20 millimicrons. Aluminum oxide particles commercially available in this range of sizes are Aluminum Oxide C and Q-LOID A-30 both of which have been found to give a good bond between the substrate and polyethylene. Aluminum Oxide C is produced by flame hydrolysis of anhydrous aluminum chloride by Degussa, Inc. and is sold by them as a water dispersable powder of aluminum oxide particles having an average particle size of about 20 millimicrons. Q-LOID A-30 is a mildly acid aqueous dispersion containing 30% aluminum oxide particles having an average particle size of about 5 millimicrons and is produced and sold by Philadelphia Quartz Company.

The aluminum oxide particles are preferably applied to the substrate as a dilute slurry of the particles in water at one or more size presses on the papermachine, but may be coated in a separate coating operation, if desired. Application may be by any method whereby a thin slurry of aluminum oxide particles can be evenly applied to paper.

In general, the amount of aluminum oxide required to give good adhesion of the polyolefin to the paper depends on the roughness of the paper, the thickness of the film, the type of film, the temperature of the extruded polyolefin film, the pressure in the cooling nip and the speed of the paper substrate web.

Using a smooth paper substrate, and extrusion coating conditions conventional to the application of a 0.5 to 2 mil polyolefin film, as little as 0.17 grams per square meter of aluminum oxide to each side of the paper substrate will improve the adhesion of the polyolefin to the paper if the coating speed is low, say about 100 feet per minute. A preferred range of aluminum oxide is from about 0.25 grams per square meter to about 0.60 grams per square meter and a most preferred range is from about 0.45 grams per square meter to about 0.50 grams per square meter of paper. At the most preferred range, coating speeds up to 600 feet per minute have been consistently obtained with good adhesion and resistance to edge penetration. Aluminum oxide coatings above 0.50 grams per square meter do not seem to improve adhesion and the edge penetration tends to be adversely affected with increasing amounts of aluminum oxide.

Although the thin coatings of aluminum oxide do not require a binder material, a binder, such as a paper coating starch may be used, if desired, in amounts up to 30% based on the aluminum oxide content. Above this amount the adhesion is adversely affected.

The aluminum oxide coated paper may be dried by steam drums on the papermachine or by any other conventional method. The dried paper may be supercalendered to give a smooth surface for applying the polyolefin film. The coated paper may be stored for several months before the polyolefin film is applied.

As in the conventional continuous extrusion coating methods, a hot polyolefin film from the extruder may be applied to the aluminum oxide coated paper substrate and the hot film may be simultaneously adhered and cooled by running the film coated paper substrate through a pressure nip between a chill roll and a rubber press roll. High, medium or low density polyethylenes or polypropylene may be used. When using the polyethylenes, the preferred extrusion melt temperature is from about 550° F. to about 650° F., the temperature of the chill roll is from about 50° F. to about 90° F. and the cooling nip pressure is from about 70 pounds to about 130 pounds per lineal inch. When polypropylene is used, the extrusion melt temperature is from about 550° F. to about 600° F. The chill roll may be smooth or may have a pattern of peaks and valleys to give a textured, for example, silk-like polyolefin surface. Polyolefin films may be applied in like manner to the both sides of the aluminum oxide coated substrate. For most photographic uses the polyolefin films may be from about 0.3 mils to about 3 mils, preferably from about 0.5 mils to about 2 mils, thick.

The polyolefin coated paper may be coated with a light sensitive silver halide emulsion coating for the production of black and white or colored prints. Treatment of the polyolefin coated paper with, for example, a corona discharge prior to coating with emulsion, may be done to facilitate adhesion of the emulsion to the polyolefin surface.

The following example illustrates a preferred embodiment of this invention.

EXAMPLE

An 8.3 mil photographic paper substrate was prepared by refining highly bleached (alpha cellulose) pulps to a Canadian Standard Freeness of 350 to 400, adding to the refined pulp, 5 pounds of Aquapel 360X per ton of pulp along with 12 pounds per ton of a cationic starch retention aid and the paper was formed and dried on a papermachine. While still on the papermachine, the paper was run through three size presses followed each time by drying. At the first size press, the paper was treated with an aqueous solution of 6% paper coating starch. At each of the second and third size presses, the paper was treated with an aqueous dispersion containing 1.8% aluminum oxide (Aluminum Oxide C-Degussa). The total pick up of aluminum oxide was approximately 0.43 grams of the oxide per side. The paper off the paper machine was calendered on a supercalender to give a smooth surface for subsequent coatings.

Paper produced as above was coated at 600 feet per minute on one side with a 1.3 mils of a medium density polyethylene using an extruder. The temperature of the polyethylene from the extruder was 590° F., the chill roll was kept at 70° F., and the nip pressure between the chill roll and the pressure roll was 120 pounds per lineal inch. A 1.2 mil coating of a high density polyethylene was similarly applied to the opposite side of the paper.

Photographic base paper so produced was subjected to the adhesion and edge penetration tests described supra. The polyethylene adhesion was excellent with no evidence of clean separation from the paper and the resistance to edge penetration was excellent.

The extrusion coated paper prepared as above and carrying a layer of aluminum oxide particles and a polyethylene film on each surface was treated by means of a corona discharge and coated with light sensitive color silver halide gelatin emulsion for color reproduction and dried. Color prints developed by conventional developing methods were of excellent quality.

What is claimed is:

1. A process for the preparation of a photographic base comprising the steps of a. applying an aqueous coating composition to at least one surface of a paper substrate, said coating composition containing aluminum oxide particles, said aluminum oxide particles having a particle size of from about 1 millimicron to about 60 millimicrons,
b. drying said coated substrate,
c. applying a molten film of a polyolefin over at least one of said coated surfaces of said coated substrate,
d. adhering said polyolefin film to said coated surface, and
e. cooling said polyolefin film to a temperature below the melt point of said polyolefin.

2. The process of claim 1 in which said paper is sized with an alkylketene dimer.

3. The process of claim 1 in which said adhering and said cooling of the polyolefin film are obtained simultaneously by passing said polyolefin coated substrate through a pressure nip between a chill roll and a rubber pressure roll.

4. The process of claim 1 in which said molten film of polyolefin is applied in a continuous extrusion process.

5. The process of claim 1 wherein said polyolefin film is a polyethylene film having a thickness of at least 0.3 mils.

6. The process of claim 5 wherein said aluminum oxide particles have an average particle size in the range from about 5 millimicrons to about 40 millimicrons.

7. The process of claim 6 wherein said aluminum oxide particles are applied at a coat weight from about 0.25 grams per square meter to about 0.60 grams per square meter.

8. The process of claim 7 wherein said aqueous coating composition containing said aluminum oxide is simultaneously coated on both sides of said paper substrate by a size press on a papermachine.

9. The process of claim 8 including applying a second molten film of polyethylene on the surface of said substrate opposite to said paper surface previously coated with said polyolefin, adhering said second polyethylene film to said opposite surface, and cooling said second polyethylene film to a temperature below the melt point of said polyethylene.

10. A process for the preparation of a photographic base comprising the steps of a. applying an aqueous coating composition to at least one surface of a sized paper, said coating composition containing aluminum oxide particles having an average particle size of from about 5 millimicrons to about 40 millimicrons,
b. drying said coated paper,
c. applying an extruded molten film of a polyolefin over at least one of said coated surfaces of said coated paper, and
d. simultaneously adhering said polyolefin film to said coated surface and cooling said polyolefin film to a temperature below the melt point of said polyolefin.

11. The process of claim 10 wherein said polyolefin film is a polyethylene film having a thickness of at least 0.3 mils.

12. The process of claim 11 wherein said aluminum oxide particles are applied at a coat weight of about 0.25 to about 0.60 grams per square meter.

13. The process of claim 12 wherein said aqueous coating composition containing said aluminum oxide is simultaneously coated on both sides of said paper by a size press on a papermachine.

14. The process of claim 13 including applying a second extruded molten film of polyethylene on the surface of said paper opposite to said surface previously coated with said polyethylene, and simultaneously adhering said second polyethylene film to said opposite surface, and cooling said second polyethylene film to a temperature below the melt point of said polyethylene.

15. A process for the preparation of a photographic base comprising the steps of a. preparing an alkylketene dimer sized paper on a paper machine,
b. applying an aqueous coating composition to each surface of said sized paper by treatment at at least one size press of said papermachine with said coating composition, said coating composition containing aluminum oxide particles having an average particle size from about 5 millimicrons to about 40 millimicrons and said aluminum oxide particles being applied at a coatweight from about 0.25 grams per square meter to about 0.60 grams per square meter on said each surface of said sized paper,
c. drying said aluminum oxide coated paper,
d. applying an extruded molten film from about 0.5 mils to about 2 mils of medium density polyethylene to one of said surfaces of said aluminum oxide coated paper,
e. adhering said medium density polyethylene film to said coated surface,
f. cooling said medium density polyethylene film to a temperature below the melt point of said medium density polyethylene,
g. applying an extruded molten film from about 0.5 mils to about 2 mils of a high density polyethylene to the other of said surfaces of said aluminum oxide coated paper,
h. adhering said high density polyethylene film to said other coated surface, and
i. cooling said high density polyethylene film to a temperature below the melt point of said high density polyethylene.

16. A process for preparing a light sensitive photographic print paper comprising the steps of a. preparing an alkylketene dimer sized paper on a papermachine,
b. applying an aqueous coating composition to each surface of said sized paper by treatment at at least one size press of said papermachine with said coating composition, said coating composition containing aluminum oxide particles having an average particle size from about 5 millimicrons to about 40 millimicrons and said aluminum oxide particles being applied at a coat weight from about 0.25 grams per square meter to about 0.60 grams per square meter on said each surface of said sized paper, c. drying said aluminum oxide coated paper, d. applying an extruded molten film from about 0.5 mils to about 2 mils of medium density polyethylene to one of said surfaces of said aluminum oxide coated paper, e. adhering said medium density polyethylene film to said coated surface, f. cooling said medium density polyethylene film to a temperature below the melt point of said medium density polyethylene, g. applying an extruded molten film from about 0.5 mils to about 2 mils of a high density polyethylene to the other of said surfaces of said aluminum oxide coated paper, h. adhering said high density polyethylene film to said other coated surface, i. cooling said high density polyethylene film to a temperature below the melt point of said high density polyethylene, j. applying a coating of a light sensitive silver halide emulsion over said medium density polyethylene film, and k. drying said emulsion coated paper.

17. A photographic base comprising a paper substrate, a layer of aluminum oxide particles on at least one surface of said paper substrate, said aluminum oxide particles having a particle size of from about 1 millimicron to about 60 millimicrons, and a polyolefin film on said layer of aluminum particles, said layer of aluminum oxide particles providing a bond between said polyolefin film and said paper substrate.

18. The photographic base of claim 17 in which said bond is stronger than the internal strength of said paper substrate.

19. The photographic base of claim 18 wherein said polyolefin film is polyethylene having a thickness of at least 0.3 mils.

20. The photographic base of claim 19 wherein said aluminum oxide particles have an average particle size from about 5 millimicrons to about 40 millimicrons.

21. The photographic base of claim 20 wherein said layer of aluminum oxide particles has a coat weight from about 0.25 grams per square meter to about 0.60 grams per square meter.

22. The photographic base of claim 18 wherein each surface of said paper carries said layer of aluminum oxide particles and said polyethylene film.

23. A photographic base comprising alkylketene dimer sized paper, a layer of aluminum oxide particles on each surface of said paper, said layer weighing from about 0.25 grams per square meter to about 0.60 grams per square meter of said paper and said aluminum oxide particles having an average particle size from about 5 millimicrons to about 40 millimicrons, a medium density polyethylene film of about 0.5 mils to about 2 mils on one of said layers of aluminum oxide particles, and a high density polyethylene film of from about 0.5 mils to about 2 mils on the other of said layers of aluminum oxide particles, said layers of aluminum oxide particles providing bonds between said polyethylenes and said paper stronger than the internal strength of said paper.

24. A light sensitive photographic print paper comprising alkylketene dimer sized paper, a layer of aluminum oxide particles on each surface of said paper, said layer weighing from about 0.25 grams per square meter to about 0.60 grams per square meter of said paper and said aluminum oxide particles having an average particle size from about 5 millimicrons to about 40 millimicrons, a medium density polyethylene film of about 0.5 mils to about 2 mils on one of said layers of aluminum oxide particles, a high density polyethylene film of from about 0.5 mils to about 2 mils on the other of said layers of aluminum oxide particles, said layers of aluminum oxide particles providing bonds between said polyethylenes and said paper stronger than the internal strength of said paper, and having a dried light sensitive silver halide emulsion coating adhered to said medium density polyethylene film.

* * * * *